US008667948B2

(12) United States Patent
Hamby

(10) Patent No.: US 8,667,948 B2
(45) Date of Patent: Mar. 11, 2014

(54) DWELL CYCLE CRANK

(76) Inventor: W. Daniel Hamby, Valdese, NC (US)

( * ) Notice: Subject to any disclaimer, the term of this patent is extended or adjusted under 35 U.S.C. 154(b) by 226 days.

(21) Appl. No.: 13/133,197

(22) PCT Filed: Dec. 23, 2009

(86) PCT No.: PCT/US2009/006700
§ 371 (c)(1),
(2), (4) Date: Jun. 7, 2011

(87) PCT Pub. No.: WO2010/077334
PCT Pub. Date: Jul. 8, 2010

(65) Prior Publication Data

US 2011/0239979 A1 Oct. 6, 2011

Related U.S. Application Data

(60) Provisional application No. 61/193,827, filed on Dec. 29, 2008.

(51) Int. Cl.
*F02B 75/32* (2006.01)

(52) U.S. Cl.
USPC ..... 123/197.3; 123/197.1; 123/197.4; 123/78 E

(58) Field of Classification Search
USPC ..... 123/197.3, 197.4, 78 E
See application file for complete search history.

(56) References Cited

U.S. PATENT DOCUMENTS

| | | | | |
|---|---|---|---|---|
| 1,505,856 | A * | 8/1924 | Briggs | 74/50 |
| 1,508,614 | A * | 9/1924 | Powell | 123/66 |
| 1,574,573 | A * | 2/1926 | Jackson | 74/36 |
| 3,753,386 | A * | 8/1973 | Scott, Jr. | 92/5 R |
| 4,584,972 | A | 4/1986 | Jayne et al. | |
| 5,655,404 | A | 8/1997 | Tsepenuk | |
| 6,202,622 | B1 | 3/2001 | Raquiza, Jr. | |
| 7,077,097 | B2 | 7/2006 | Spangler | |

* cited by examiner

*Primary Examiner* — Rinaldi Rada
*Assistant Examiner* — Omar Morales
(74) *Attorney, Agent, or Firm* — Jeffrey Watson; Balser & Grell IP Law

(57) ABSTRACT

The dwell cycle crank includes a reciprocating piston having a piston head or cylinder, a main body connected to the piston head, a cap detachably mounted to the main body, an S-shaped cam formed between the main body and the cap, a follower disposed in the S-shaped cam, a rotatable crankshaft, and an offset journal disposed between the connecting bearing and the crankshaft to thereby form a torque arm. The S-shaped cam and connecting bearing create periodic dwells and faster strokes in the crank cycle to maximize volumetric and geometric efficiencies of the engine.

7 Claims, 5 Drawing Sheets

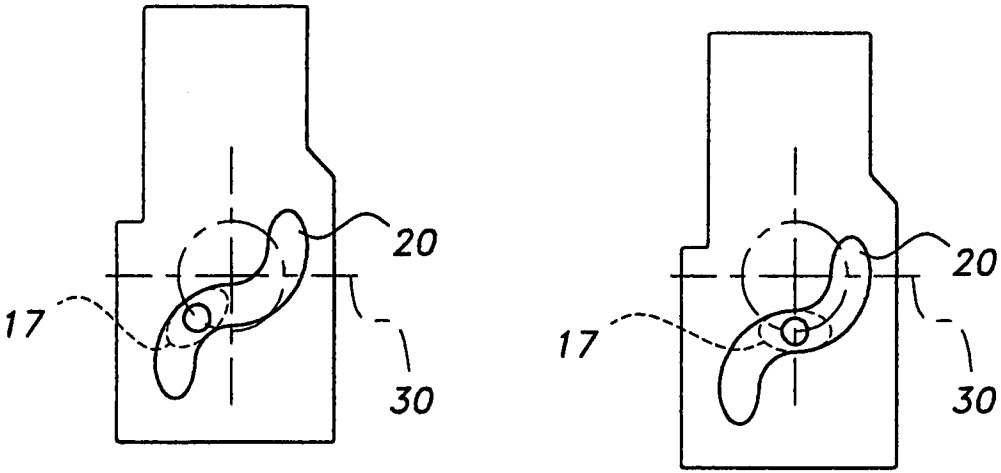
FIG. 3D
FIG. 3E
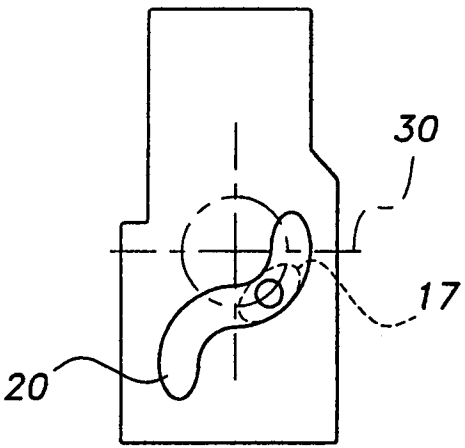
FIG. 3F

DWELL CYCLE CRANK

CROSS REFERENCE TO RELATED APPLICATIONS

This application claims priority to PCT application Ser. No. PCT/US09/06700 filed on Dec. 23, 2009, and to U.S. provisional patent application Ser. No. 61/193,827, filed on Dec. 29, 2008, which are incorporated by reference herein.

BACKGROUND OF THE INVENTION

1. Field of the Invention

The present invention relates to reciprocating engines, and more particularly to a dwell cycle crank configuration that efficiently utilizes energy to convert reciprocating linear motion to rotary motion or vice versa.

2. Description of the Related Art

A conventional internal combustion engine (ICE) having a piston cylinder attached to a crank armor yoke offset from the crank shaft proceeds through various processes in a typical cycle; intake, compression, power, and exhaust. In a four-stroke engine, each process occurs in each stroke of the piston, i.e. first stroke (downward) corresponds to an intake process or charging of a fuel-air mixture, second stroke (upward) corresponds to a compression process of the mixture, third stroke (downward) corresponds to 15 a power process in which the mixture is ignited to produce energy for turning the crank, and fourth stroke (upward) corresponds to the exhaust process which vents the waste products of combustion from the piston chamber. The directions indicated above in parentheses are mainly illustrative of a configuration in which the piston cylinder is arranged to reciprocate in a vertical orientation. It is noted that many conventional ICEs include various configurations of pistons that depart from vertical.

Another common type of ICE is a two-stroke engine in which-two of the four processes mentioned above occur in the same stroke. For example, the first stroke (downward) includes the intake and power processes while the second stroke (upward) includes the compression and exhaust processes.

The efficiency of any of the above mentioned engines is measured in part by how an engine maximizes the thermo energy produced via combustion, since an ICE is fundamentally a practical application of heat transfer thermodynamics. It is recognized that many factors are involved in determining the efficiency of an ICE, e.g. the crank and piston geometry, compression ratios, charge durations, burn durations, engine tuning parameters, air-fuel mixture, engine block temperature, etc. However, one of the main factors for inefficient operation in an engine is potential heat loss during a cycle. Some attributing examples may be mistimed ignition of the air-fuel mixture that results in less than maximum consumption of the resource and thereby produce sub-optimal power to turn the crank, or simple heat loss between the piston cylinder chamber and the surrounding engine block and/or other attached components. Hence, most commercial engines in vehicles have roughly 20% efficiency. Due to current economics and dwindling resources, there exists a need for more efficient engines.

Thus a dwell cycle crank solving the aforementioned problems is desired.

SUMMARY OF THE INVENTION

The dwell cycle crank includes a reciprocating piston having a piston head or cylinder, a main body connected to the piston head, a cap detachably mounted to the main body, an S-shaped cam formed between the main body and the cap, a connecting bearing or follower disposed in the S-shaped cam, a rotatable crankshaft, and an offset journal disposed between the connecting bearing and the crankshaft to thereby form a torque arm. The S-shaped cam and connecting bearing create dwells and faster strokes at key points in the crank cycle to maximize volumetric and geometric efficiencies of the engine.

These and other features of the present invention will become readily apparent upon further review of the following specification and drawings.

BRIEF DESCRIPTION OF THE DRAWINGS

FIGS. 3A, 3B, 3C, 3D, 3E, 3F, 3G, and 3H are schematic views of various stages in a cycle of a dwell cycle crank according to the present invention.

Similar reference characters denote corresponding features consistently throughout the attached drawings.

DETAILED DESCRIPTION OF THE PREFERRED EMBODIMENTS

Figure 1:
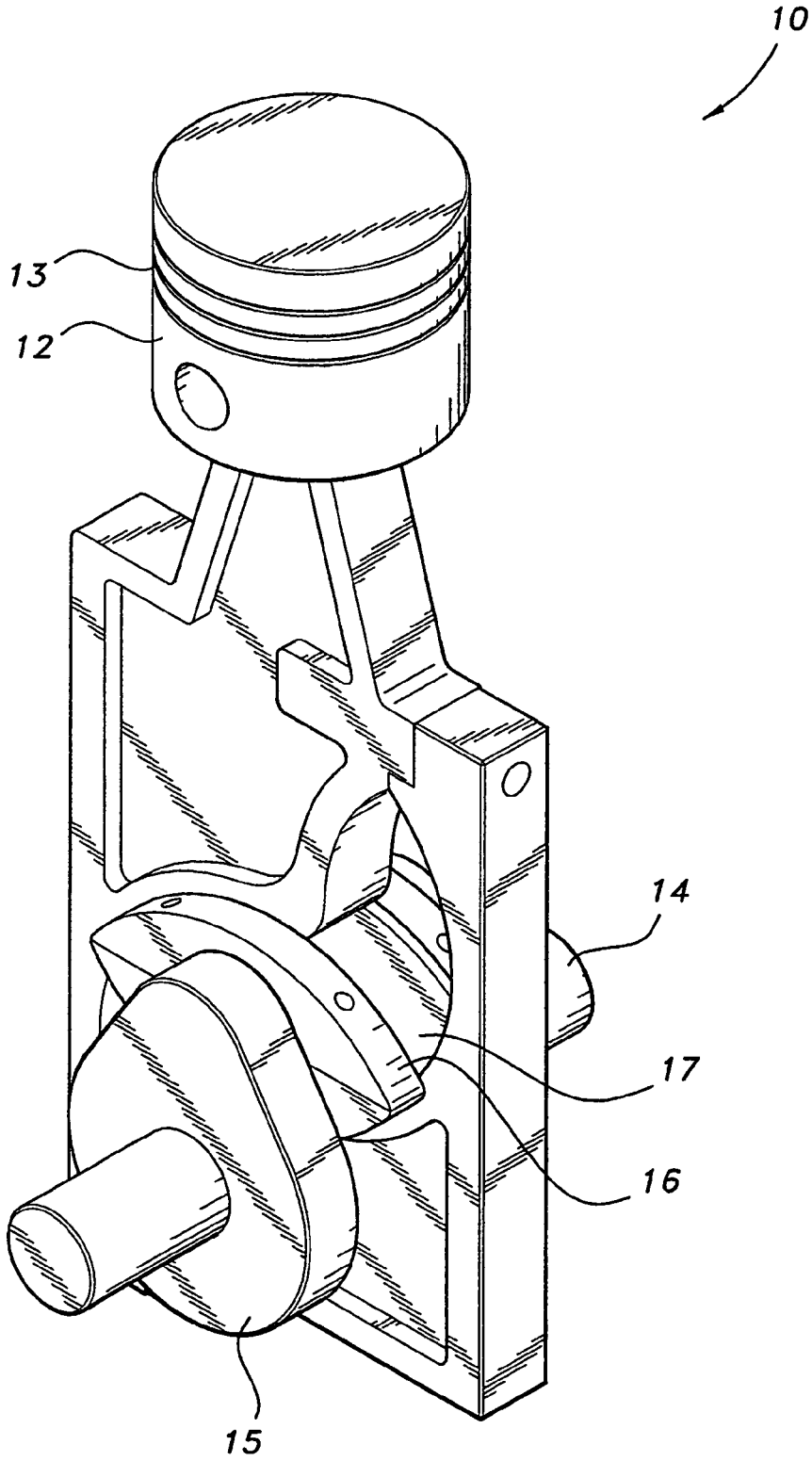
FIG. 1 is an environmental, perspective view of a dwell cycle crank according to the present invention.
Figure 2:
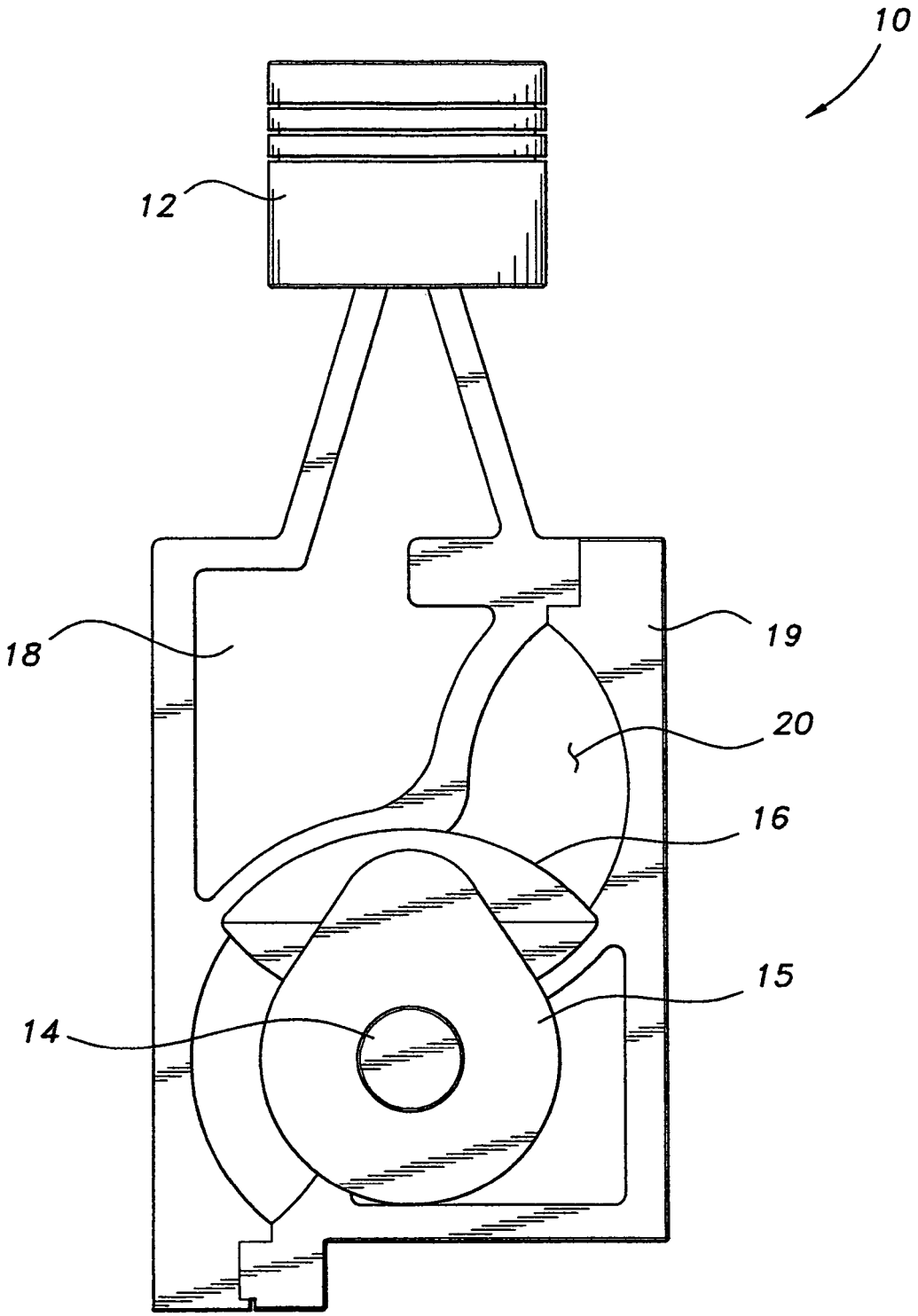
FIG. 2 is a front view of a dwell cycle crank according to the present invention.

The present invention relates to a dwell cycle crank 10 that works with increased efficiency. As shown in FIGS. 1-2, the dwell cycle crank 10 includes a reciprocating piston having a piston head or cylinder 12 pivotably connected to a main body 18. The piston is adapted to reciprocate in a straight line within the cylinder chambers of an engine, and the reciprocating motion of the piston is translated to rotation of a crank. The piston head 12 includes annular grooves 13 for mounting seal rings (not shown). The lower diagonal portion of the main body 18 has a curvilinear profile that forms half of an overall cam. A cap 19 is detachably mounted to the main body 18, and the upper diagonal portion of the cap 19 has a curvilinear profile that forms the other half of the overall cam. Thus, as more clearly shown in FIG. 2, the curvilinear profiles of the main body 18 and the cap 19 together form a curvilinear slot or an S-shaped cam 20.

The piston is operatively connected to a crankshaft 14 via a torque arm/offset journal 15. In turn, the offset journal 15 is attached to a connecting bearing or follower 17, which is disposed within and adapted to 15 ride between the extreme ends of the cam 20. The follower 17 is substantially oval shape that conforms to the shape of the cam. The follower 17 may be composed of two identical halves mountable on the bearing of the offset journal 15. Each identical half includes outwardly extending flanges 16 at the ends thereof. When assembled, these flanges 16 are disposed on opposite sides of the main body 18 and cap 19, and they project a certain extent past the edge of the S-shaped cam 20 to thereby prevent any inadvertent disengagement of the follower 17 from the same.

Turning to FIGS. 3A-3H, the following discuss how increased efficiency may be obtained by the dwell cycle crank 10. It is noted that the description relates to one complete cycle of 360 degree rotation of the crankshaft 14. Moreover, reference numeral 30 represents a comparative reference line to determine relative reciprocating motion of the piston.

Figure 3C:
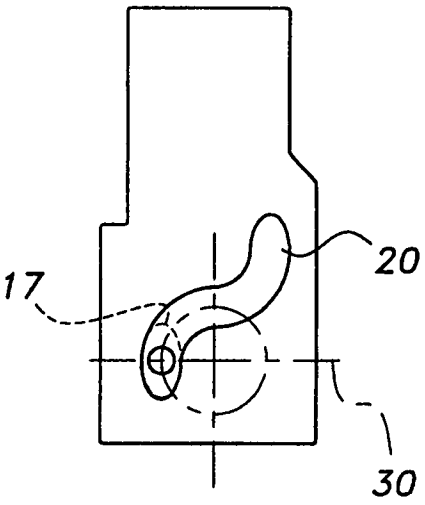
Figure 3B:
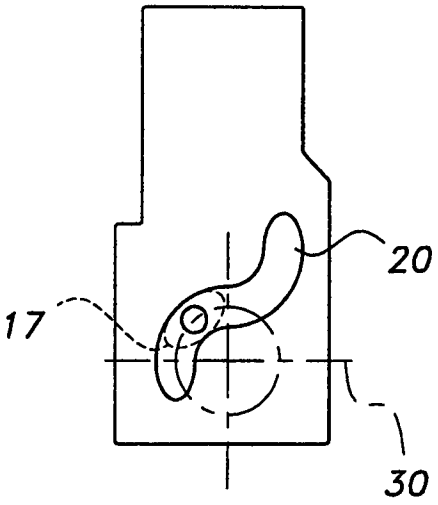
Figure 3A:
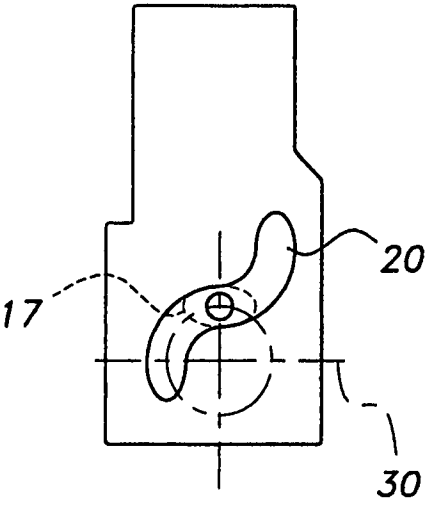
Figure 3H:
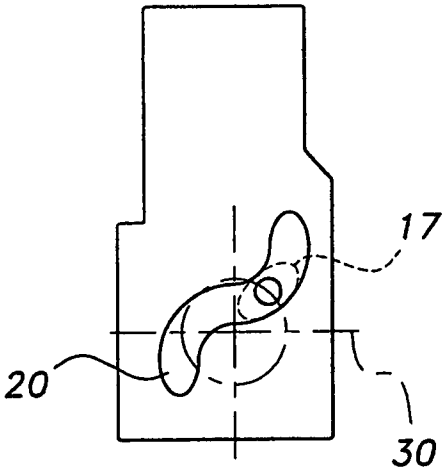

In FIGS. 3A-3C, the piston is locked at top dead center (TDC) while the follower 17 has moved from centered in the S-shaped cam 20, to 45 degrees, to 90 degrees respectively in the Figures. The piston is prevented from movement, i.e.

downward, due to the interface and position of the follower 17 in the S-shaped cam 20 at each stage. This is the first dwell stage in the cycle.

At the stage shown in FIG. 3C, the piston is free to move downward. From FIGS. 3C-3E, the piston has reached bottom dead center (BDC) within a span of 90 degrees rotation of the crankshaft 14, i.e. the follower 17 has traveled back along the S-shaped cam 20 from the 90 degree mark to the 135 degree and the 180 degree marks. The effects of these stages of the cycle will be further discussed below.

Figure 3G:
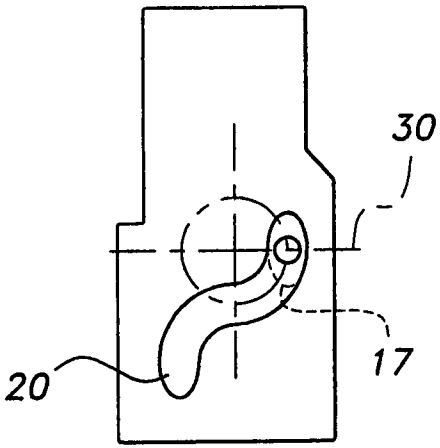

In the stages shown in FIGS. 3E-3G, the piston is locked at BDC while the follower 17 has moved from centered in the S-shaped cam 20 at 180 degrees to 225 degrees and 270 degrees respectively in the Figures. The piston is prevented from movement, i.e. upward, due to the interface and position of the follower 17 in the S-shaped cam 20 at each stage. This is the second dwell stage in the cycle.

At the stage shown in FIG. 3G, the piston is free to move upward. From FIGS. 3G, 3H, and back to 3A, the piston has reached TDC within a span of 90 degrees rotation of the crankshaft 14, i.e. the follower 17 has traveled back along the S-shaped cam 20 from the 270 degree mark to the 315 degree and the 360 degree marks. The effects of these stages of the cycle will be further discussed below. At this point, the cycle repeats itself.

Referring to FIGS. 3C-3G where the dwell cycle crank 10 performs a downward stroke stage and a second dwell stage, these stages produce greater volumetric efficiency. Compared to some conventional engines in which a piston stroke occurs in 180 degrees of rotation of the crankshaft, the dwell cycle crank 10 performs the same stroke in a span of 90 degrees. This means a much faster stroke, i.e. same volume traversed in less time compared to conventional. The faster stroke creates higher negative pressure or ram effect within the piston chamber of the engine block. Thus, any given charge being introduced at that span of time will be drawn at a quicker rate. The subsequent dwell stage shown in FIGS. 3E-3G allows the given charge more time to fill the chamber. These two features maximize the volume of the given charge and thereby increase the volumetric efficiency of the engine.

Referring to FIGS. 3G, 3H, and 3A-3C where the dwell cycle crank 10 performs an upward stroke stage and a first dwell stage, these stages produce greater geometric efficiency. From the stages shown in FIGS. 3G, 3H and 3A, the dwell cycle crank 10 performs an upward stroke at a faster rate than conventional in same manner described above. This results in compression of the charge at a much faster rate whereby a higher compression ratio may be obtained for the given volume of the piston chamber. A higher compression ratio maximizes the potential energy in the mass of the given charge to be translated into mechanical energy for the engine. The second dwell stage from FIGS. 3A-3C provides time to allow the pressure to build, and in the case of ICEs, time for a more complete burn of the charge.

The geometric efficiency occurs at the stage shown in FIG. 3C. In conventional IC engines, the compressed charge is ignited about 8-12 degrees before TDC and continues about 20 degrees past TDC as a way to ensure a more complete burn. As a result, less than peak pressure is applied to the crank due to application of the pressure on the offset journal at varying compound angles. In contrast, the dwell cycle crank 10 allows application of peak pressure at the most advantageous angle, i.e. at or close to 90 degrees as shown in FIG. 3C. In other words, a given force acting on a crank arm is less effective or diminishes the further the force deviates from perpendicular. The shape of the follower 17 ensures that the most advantageous angle for application of pressure can be obtained because it minimizes compound angle application. Thus, geometric efficiency is achieved by the above features.

It is noted that the dwell cycle crank 10 may encompass a variety of alternatives to the various features thereof. For example, the dwell cycle crank 10 has application in a variety of different engines, and it is not limited to ICEs. The various parts may be constructed from any combination of metals or materials that suitable for the desired efficiency and performance.

It is to be understood that the present invention is not limited to the embodiments described above, but encompasses any and all embodiments within the scope of the following claims.

I claim:

1. A dwell cycle crank, comprising:

a reciprocating piston having a piston cylinder and a body, the body having an S-shaped slotted cam formed therein;

said S-shaped slotted cam comprising:

a first curve of approximately 90 degrees connected to a second curve in the opposite direction of approximately 90 degrees;

a follower adapted to ride in the cam; and a crankshaft having a torque arm operatively attached to the follower;

wherein interaction of the cam and follower during a cycle creates periodic dwells and strokes maximizing volumetric and geometric efficiency of an engine.

2. The dwell cycle crank according to claim 1, wherein the body further comprises: a main body portion having a lower diagonal curvilinear profile; and a cap detachably mounted to the main body portion, the cap having an upper diagonal curvilinear profile; wherein the profiles of the main body portion and the cap define the S-shaped slotted cam.

3. The dwell cycle crank according to claim 1, wherein the follower is substantially oval.

4. The dwell cycle crank according to claim 1, wherein the follower having two identical halves mountable on a bearing of the offset journal.

5. The dwell cycle crank according to claim 1, wherein the follower having outwardly extending flanges disposed on opposite sides of the S-shaped slotted cam and projecting past the edge of the S-shaped cam, thereby preventing disengagement of the follower.

6. The dwell cycle crank according to claim 1, whereby, when said crankshaft rotating 360 degrees said piston having a first dwell cycle, a downward movement, a second dwell cycle, and an upward movement.

7. The dwell cycle crank according to claim 6 wherein:

said first dwell cycle being said piston being locked at top dead center for 90 degrees of rotation of said crankshaft when the follower being moved from centered in the S-shaped cam to the bottom of the S-shaped slotted cam;

said downward movement being said piston moving downward from top dead center to bottom dead center during 90 degrees of rotation of said crankshaft when the follower being moved from the bottom of the S-shaped slotted cam to the middle of the S-shaped slotted cam;

said second dwell cycle being said piston being locked at bottom dead center for 90 degrees of rotation of said crankshaft when the follower being moved from centered in the S-shaped cam to the top of the S-shaped slotted cam; and said upward movement being said piston moving upward from bottom dead center to top dead center during 90 degrees of rotation of said crankshaft when the follower being moved from the top of the S-shaped slotted cam to the middle of the S-shaped slotted cam.

* * * * *